US006241853B1

(12) United States Patent
Smith et al.

(10) Patent No.: US 6,241,853 B1
(45) Date of Patent: Jun. 5, 2001

(54) HIGH WET AND DRY STRENGTH PAPER PRODUCT

(75) Inventors: Michael John Smith, Neenah; Gary L. Bushman, Menasha, both of WI (US)

(73) Assignee: Kimberly Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/208,702

(22) Filed: Dec. 10, 1998

(51) Int. Cl.[7] ..... D21H 11/00; D21H 17/07; D21H 17/32; D21H 17/27; D21H 17/45; D21H 17/52

(52) U.S. Cl. ..... 162/141; 162/177; 162/175; 162/178; 162/164.3; 162/164.6; 428/340

(58) Field of Search ..... 162/178, 183, 162/123, 141, 109, 149, 164.1, 164.3, 164.6, 177, 175, 127, 158; 428/152–154, 340

(56) References Cited

U.S. PATENT DOCUMENTS

| | | | | |
|---|---|---|---|---|
| 3,058,873 | | 10/1962 | Keim et al. | 162/164 |
| 4,652,390 | | 3/1987 | Strampach et al. | 252/92 |
| 4,735,738 | | 4/1988 | Willman | 252/90 |
| 5,048,589 | | 9/1991 | Cook et al. | 162/109 |
| 5,316,623 | * | 5/1994 | Espy | 162/164.3 |
| 5,318,669 | * | 6/1994 | Dasgupta | 162/164.3 |
| 5,338,407 | * | 8/1994 | Dasgupta | 162/168.3 |
| 5,399,412 | | 3/1995 | Sudall et al. | 428/153 |
| 5,502,091 | | 3/1996 | Dasgupta | 524/55 |
| 5,607,551 | | 3/1997 | Farrington, Jr. et al. | 162/109 |
| 5,616,207 | | 4/1997 | Sudall et al. | 156/246 |
| 5,672,248 | | 9/1997 | Wendt et al. | 162/109 |
| 5,746,887 | | 5/1998 | Wendt et al. | 162/109 |
| 5,772,845 | * | 6/1998 | Farrington, Jr. et al. | 162/109 |

* cited by examiner

*Primary Examiner*—Jose Fortuna
(74) *Attorney, Agent, or Firm*—Brinks Hofer Gilson & Lione

(57) ABSTRACT

A soft, flexible yet strong paper product is provided from the unique configuration of particular pulp types, cationic wet strength resins, and anionic processing aids.

12 Claims, 3 Drawing Sheets

HIGH WET AND DRY STRENGTH PAPER PRODUCT

BACKGROUND OF THE INVENTION

In consumer and industrial paper products strength is an important feature. For example in consumer and industrial paper towels both wet and dry strength are important features to performance and user acceptance of a towel. Many chemical and fiber furnishes and processes have been used in attempts to obtain both increased wet and dry strength, while maintaining other factors and features in a favorable light, such as cost of material, production costs, product efficiency and feel of the product. Methods and products that have provided for a very well received soft and yet strong paper sheet are those directed to an uncreped through-air-dried sheet, such as those disclosed in U.S. Pat. Nos. 5,048,589; 5,399,412; 5,607,551; 5,616,207; 5,672,248; 5,746,887 and pending U.S. patent application Ser. No. 08/310,186 filed Sep. 21, 1994, all of which are assigned to Kimberly-Clark, and the disclosures of which are herein incorporated by reference.

SUMMARY OF THE INVENTION

In an embodiment of the present invention there is provided a strong soft absorbent paper product comprising: paper making fibers, an anionic processing aid, and a cationic wet strength resin; the product having a basis weight of from about 15 to about 80 grams/square meter; a GMT of at least about 2200; and a GM Modulus of less than about 11,000 g. This paper product may also comprise paper making fibers having a % RBA of from about 17 to about 22, a number of fibers per gram of from about 5 million to about 9 million, and a carboxyl content in meq/100 g of from about 1.5 to about 3.0. This paper product may be a paper towel and the paper making fibers may be fibers having a % RBA of at least about 17 and the anionic processing aid may be a carboxymethylcellulose. This paper product may be multilayered, or it may be blended. This paper product may further have a ratio of GM Modulus over GM Tensile (i.e., GM Modulus/GM Tensile) of less than about 12.

In another embodiment of the present invention there is provided a strong soft absorbent paper product comprising: paper making fibers having less than about 9 million fibers per gram; an anionic processing aid; and less than about 18 Kg./meteric ton of a cationic wet strength resin; the paper product having a basis weight of from about 30 to about 50 grams/square meter and a wet CD tensile of at least about 730 g. This paper product may also comprise paper making fibers having a % RBA of from about 17 to about 22, a number of fibers per gram of from about 5 million to about 9 million, and a carboxyl content in meq/100 g of from about 1.5 to about 3.0. This paper product may be a paper towel and the paper making fibers may further comprise paper making fibers having a % RBA of from at least about 17, and the anionic processing aid may be a carboxymethylcellulose. This paper product may be multilayered or it may be a single layer blended sheet.

In yet a further embodiment of the present invention there is provided a strong soft absorbent paper product comprising: paper making fibers selected from the group consisting of NB-88 pulp, Marathon pulp, and K-10s pulp; an anionic processing aid, and a cationic wet strength resin; the paper product having a GMT of at least about 2,200; and a basis weight of from about 25 to about 50 grams/square meter.

In another embodiment of the present invention there is provided a strong soft absorbent paper product comprising: paper making fibers, an anionic processing aid, and a cationic wet strength resin; the product having a basis weight of from about 15 to about 80 grams/square meter; a GMT of at least about 2200; and a GM Modulus of less than about 10,000 g. This paper product may also have a ratio of GM Modulus over GM Tensile of less than about 12.

DRAWINGS

Figure 3A:
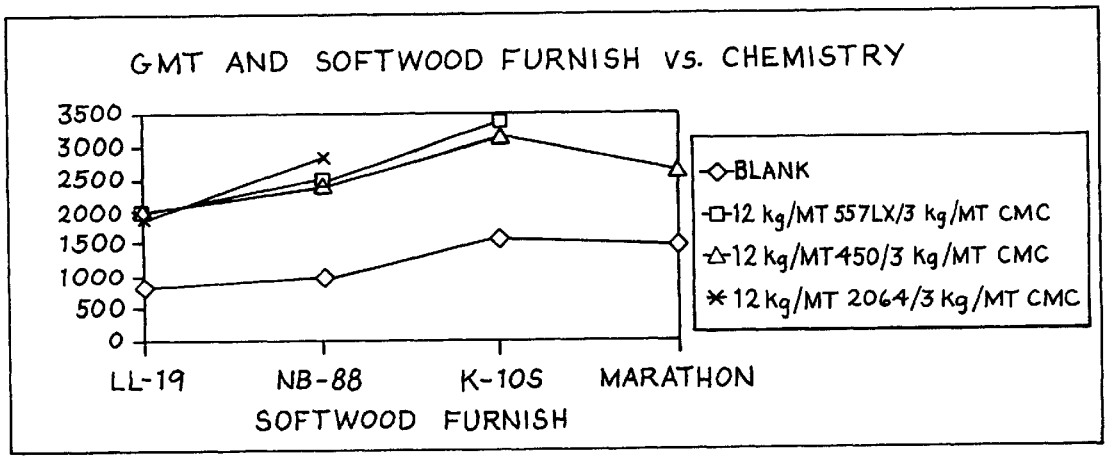
Figure 3B:
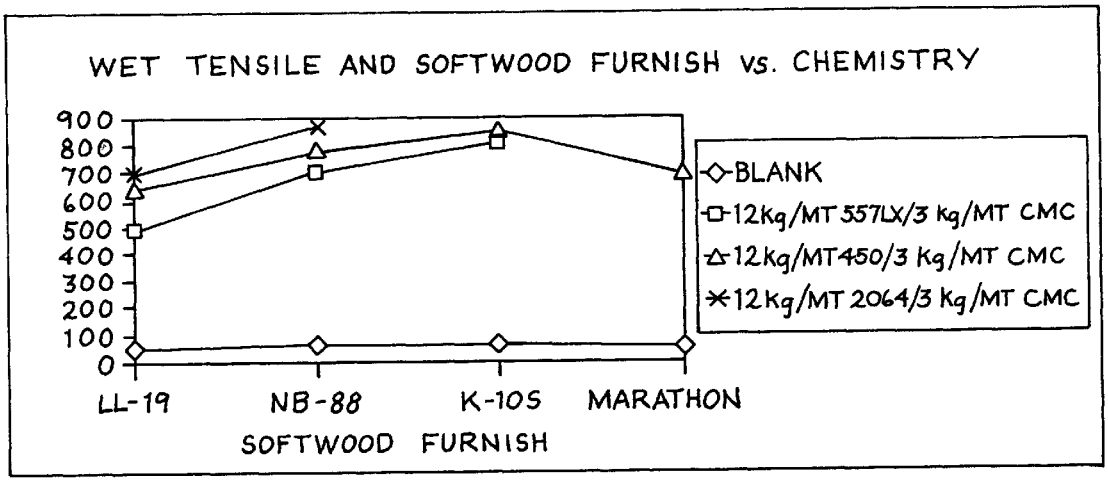
Figure 3C:
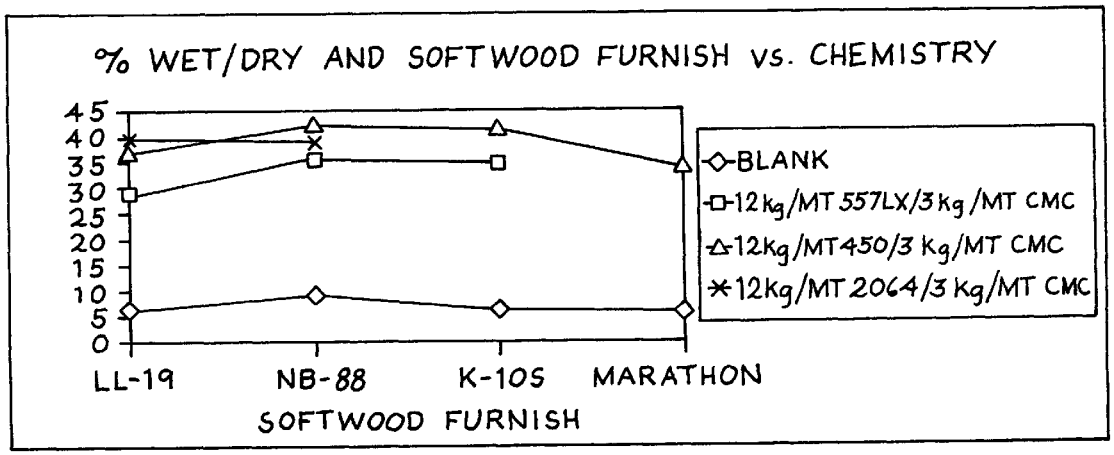

FIGS. 3A, 3B, & 3C are charts showing physical properties of sheets.

DETAILED DESCRIPTION OF PRESENTLY PREFERRED EMBODIMENTS OF THE INVENTION

Generally, it has been discovered that the use of particular fibers in combination with cationic wet strength resins and anionic processing aids gives rise to a unique and surprising paper product that has increased wet and dry strengths, as measured, for example, by the tests set forth herein.

The unique combination of these variables in a papermaking furnish that is used in an uncreped through-air-dried process, such as set forth in the above referenced Kimberly-Clark patents and patent applications, which are incorporated herein by reference, gives rise to paper products with greatly improved properties and features.

Generally, sheets of the present invention can have increased CD wet and dry tensile strengths of about 10% to about 30% when compared to a sheet having a similar basis weight and chemical addition rates, but not otherwise employing the unique combination of this invention.

Figure 1:
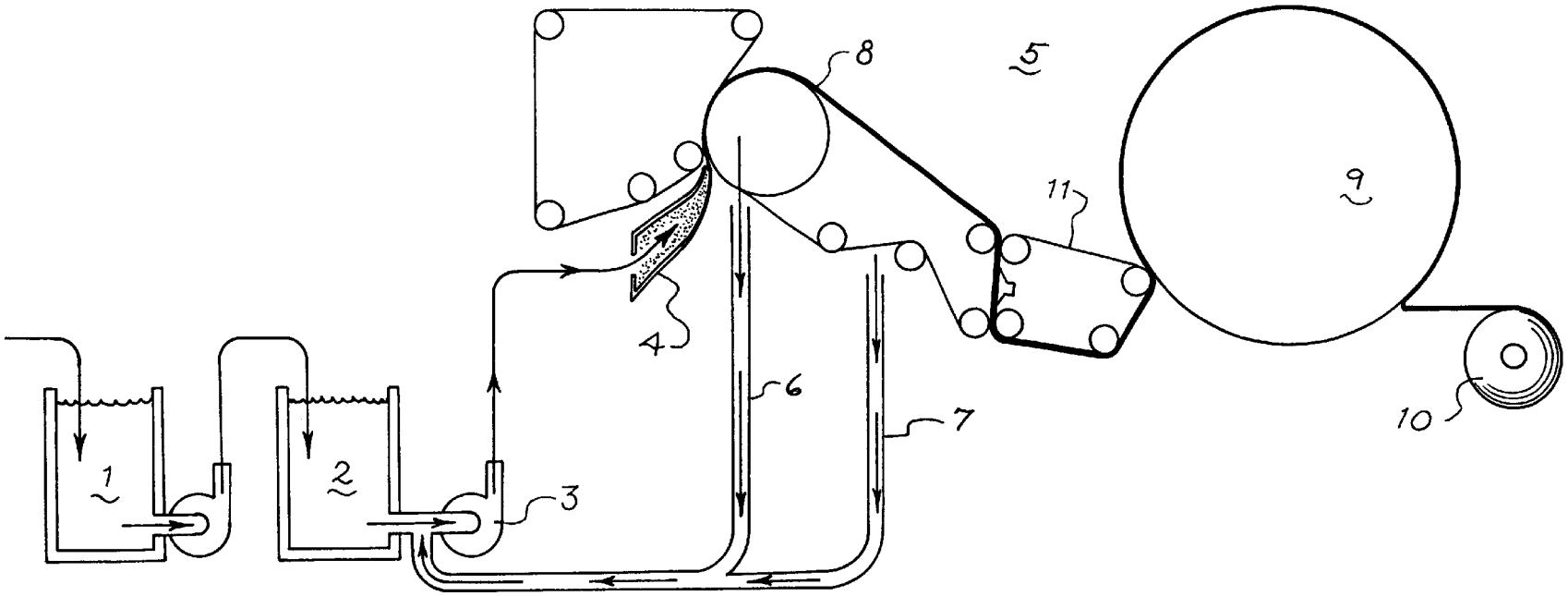
Fig. 1 Prior Art
FIG. 1 is a schematic process flow diagram generally showing the manufacture of paper products.

Referring to FIG. 1, which is a very general schematic process flow diagram of a paper making process, cellulose fibers are prepared in a pulper (not shown) to form an aqueous slurry of fibers and water, which is referred to as stock or a stock solution. The stock is pumped into a chest 1, which may be referred to as a dump chest. From the dump chest the stock is pumped to another holding chest 2, which may be referred to as a machine chest. From the machine chest the stock is pumped by the fan pump 3 to the head box 4 of the paper making machine 5. At or before the fan pump, the stock is diluted with water. Usually, and preferably, the dilution is done with return water, referred to as white water, from the paper making machine. The flow of the white water is shown by lines 6 and 7. Prior to dilution the stock is referred to as thick stock, and after dilution the stock is referred to as thin stock.

The thin stock is then dewatered by the forming section 8 of the paper machine to form an embryonic web of wet cellulose fibers. The wet web is than transferred to a dryer 9, which removes water from the wet web forming a paper sheet. The paper sheet then leaves the dryer and is wound on reel It is to be understood that FIG. 1 is a general description of the paper making process and is meant to illustrate that process and is in no way meant to limit or narrow the scope of the present invention. Many variations in this process and equipment are know to those skilled in the art of paper making. For example, various types of dryers can be used including through-air-dryers, Yankee dryers with and without creping, tunnel dryers, and can dryers or any combination of these. Although the schematic generally shows a twin wire type forming section, other forming sections known to the art may be used. Additional components may also be added or removed from the process. For example, screens, filters and refiners, which are not illustrated, may be typically placed between the pulper and the head box. The transfer section 11 of the paper machine may not be present or may be expanded to include additional water removal devices. Additional steps may also be added on-machine after the dryer and before the reel, such as calendering and the use of a size press, although additional drying is usually required after a size press application is used. Calendering and coating operations may also be conducted off-machine.

Figure 2:
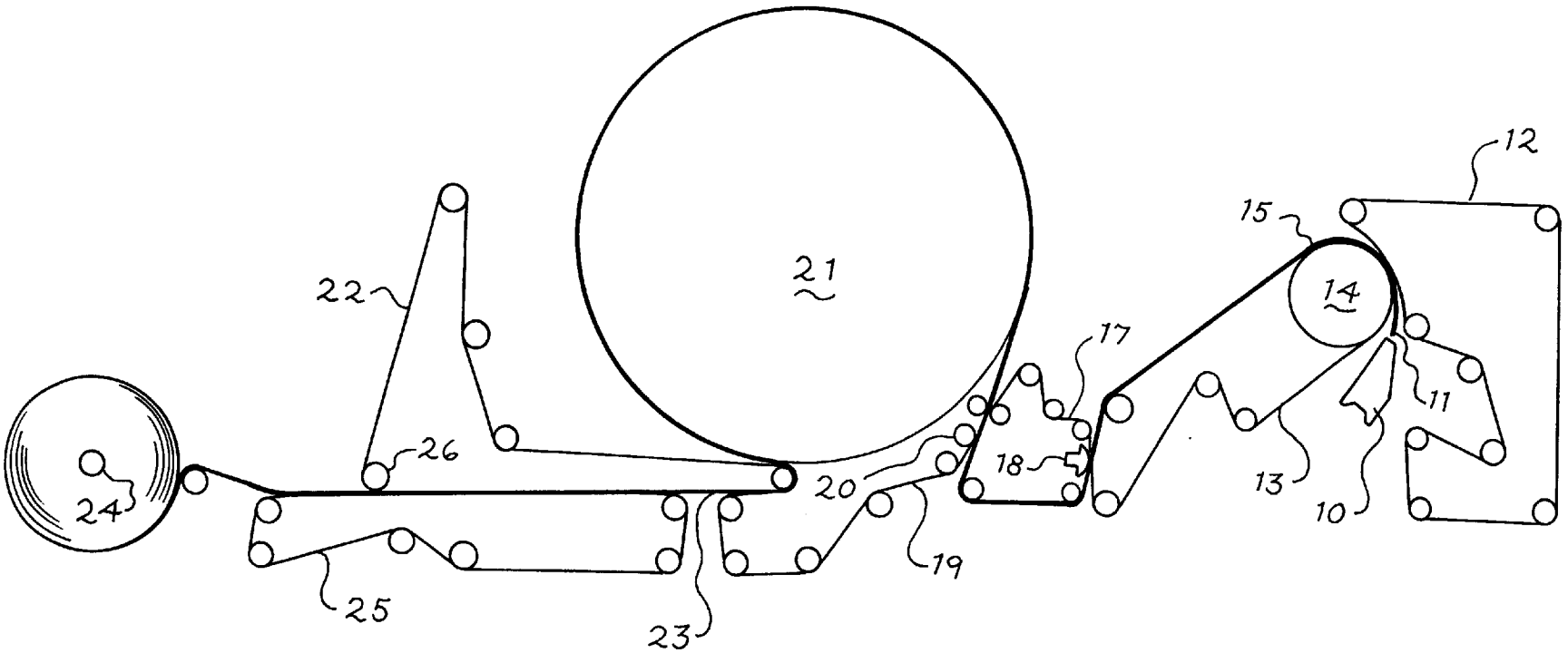
Fig. 2 Prior Art
FIG. 2 is a schematic process flow diagram generally showing the manufacture of uncreped through-air-dried paper products.

FIG. 2 illustrates a more specific type of apparatus and process for making paper along the lines of the process disclosed in the above referenced Kimberly-Clark patents and patent applications, which are incorporated herein by reference. Shown in this FIG. 2, is a twin wire former having a layered papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weigh percent. Additional dewatering of the wet web can be carried out, such as by vacuum suction, while the wet web is supported by the forming fabric.

The wet web is then transferred from the forming fabric to a transfer fabric 17 traveling at a slower speed than the forming fabric in order to impart increased stretch into the web. The difference in the speeds of these two fabrics is referred to as the Rush Transfer Percent. Transfer is preferably carried out with the assistance of a vacuum shoe 18 and a fixed gap or space between the forming fabric and the transfer fabric or a kiss transfer to avoid compression of the wet web.

The web is then transferred from the transfer fabric to the throughdrying fabric 19 with the aid of a vacuum transfer roll 20 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer is preferably carried out with vacuum assistance to ensure deformation of the sheet to conform to the throughdrying fabric, thus yielding desired bulk and appearance.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is finally dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

It is to be understood that FIG. 2 although a more specific description of the paper making process is meant to further illustrate that process and is in no way meant to limit or narrow the scope of the present invention. Many variations in this process and equipment are known to those skilled in the art of paper making.

Generally, the anionic processing aid may be added at any point in the processes, where it will come in contact with the paper fibers prior to their forming the wet web. For example, the anionic processing aid may be added to the thick or the thin stock directly, in may be added at the tray (to the white water), the fan pump, the head box, the machine chest, the dump chest or the pulper. Ideally the anionic processing aid is added to the thick stock and optimally it is added to the dump chest or the pulper, or at a similar point in the process. It should be noted, however, that the optimal addition point may vary from paper machine to paper machine and grade of paper to from grade of paper.

From about 1 to about 20 lbs./ton of dry paper fibers of the anionic processing aid may be used, ideally from about 6 to about 15 lbs./ton (about 3 to 7.5 Kg./metric ton), and optimally from about 8 to about 10 lbs./ton.

The anionic processing aids useful for the purposes of this invention include without limitation cellulose type products, such as carboxymethylcellulose (CMC which may be obtained from Hercules Inc. Wilmington, Del.), Guar gums, and Locust bean gums. CMC-7MT is an example of a grade of carboxymethylcellulose available from Hercules that may be used. Other grades may also be used including without limitation grades having higher molecular weights. In addition to these examples of anionic processing aids, DP-80, which is a polymaleic acid copolymer developed, marketed by FMC, Inc., may be used. DP-80, however, requires high temperature curing of 190° C. for 2 minutes.

Generally, the cationic wet strength resin may be added at any point in the processes, where it will come in contact with the paper fibers prior to forming the wet web. For example, the cationic wet strength resin may be added to the thick or the thin stock directly, in may be added at the tray, the fan pump, the head box, the machine chest, the dump chest or the pulper. Ideally the cationic wet strength resin is added to the thick stock and optimally it is added to the thick stock in proximity to the addition point of the anionic processing aid. It should be noted, however, that the optimal addition point may very from paper machine to paper machine and from grade of paper to grade of paper.

From about 5 to about 50 lbs./ton of dry paper fibers of the cationic wet strength resin may be used, ideally from about 24 to about 36 lbs./ton (about 12–18 Kg./metric ton), and optimally from about 15 to about 20 lbs./ton.

The cationic wet strength resins useful in this invention include without limitation cationic water soluble resins. These resins impart wet strength to paper sheets and are well known to the paper making art. They may be obtained from companies, such as Cytec, Inc., Hercules, Inc., Callaway Chemical Co., Georgia Pacific Resins, and Borden. These resin may impart either temporary or permanent wet strength to the sheet. For example, without limitation, KYMENE® resins obtainable from Hercules Inc., Wilmington, Del. may be used. By way of example and without limitations, such resins include the following Hercules products.

KYMENE® 736 which is a polyethyleneimine (PEI) wet strength polymer. It is believed that the PEI imparts wet strength by ionic bonding with the pulps carboxyl sites. KYMENE® 557LX is polyamide epichlorohydrin (PAE) wet strength polymer. It is believed that the PAE contains cationic sites that lead to resin retention by forming an ionic bond with the carboxyl sites on the pulp. The polymer contains 3-azetidinium groups which react to form covalent bonds with the pulps' carboxyl sites as well as crosslink with the polymer backbone. The product must undergo curing in the form of heat or undergo natural aging for the reaction of the azentidinium group. KYMENE® 450 is a base activated epoxide polyamide epichlorohydrin polymer. It is theorized that like 557LX the resin attaches itself ionically to the pulps' carboxyl sites. The epoxide group is much more reactive than the azentidinium group. The epoxide group reacts with both the hydroxyl and carboxyl sites on the pulp, thereby giving higher wet strengths. The epoxide group also can crosslink to the polymer backbond. KYMENE® 2064 is also a base activated epoxide polyamide epichlorohydrin polymer. It is theorized that KYMENE® 2064 imparts its wet strength by the same mechanism as KYMENE® 450. KYMENE® 2064 differs in that the polymer backbond contains more epoxide functional groups than does KYMENE® 450. Both KYMENE® 450 and KYMENE® 2064 require curing in the form of heat or natural aging to fully react all the epoxide groups, however, due to the reactiveness of the epoxide group, the majority of the groups (80–90%) react and impart wet strength off the paper machine.

The points of addition for the anionic processing aid and the cationic wet strength resin may vary or be in the same general location. Thus, the anionic processing aid may be added before, after, or at the same time as the cationic wet strength resin in the process. When the anionic processing aid and the cationic wet strength resin are added at or near the same general point, for example to the same chest, care should be taken to separate their respective addition points. For example, the addition points could be placed on opposite sides of the chest.

Paper sheets can be made of long paper making fibers (softwood), short paper making fibers (hardwood), secondary fibers, other natural fibers, synthetic fibers, or any combination of these or other fibers known to those skilled in the art of paper making to be useful in making paper. Long paper making fibers are generally understood to have a length of about 2 mm or greater. Especially suitable hardwood fibers include eucalyptus and maple fibers. As used herein the term paper making fibers refers to any and all of the above.

As used herein, and unless specified otherwise, the term sheet refers generally to any type of paper sheet, e.g., tissue, towel facial, bath or a heavier basis weight product, creped or uncreped, blended, multilayer (e.g., double and triple layers) or single layered, and multiplied or single plied.

It has been discovered that fibers having particular physical and chemical attributes when combined with cationic wet strength resins and anionic processing aids provide sheets having substantially increased strength, with little or no increase in stiffness (by way of example, and without limitation, as measured by GM Modulus and GM Modulus/GMT).

The following table (table 1) summarizes some relevant fiber morphology.

TABLE 1

| Fiber Type | Composition | Fiber Length (mm) | Coarseness LW (mg/100 m) | Freeness 100 revs PFI | % RBA | # Fibers per 12.5 gram (millions/gram) | Carboxyl Content (meq/100 g)[10] |
|---|---|---|---|---|---|---|---|
| LL-19 | 65–75% Spruce<br>20–25% Jack Pine<br>5–10% Fir | 1.02 | 14.4 | 625 | 16.6 | 6.8 | 2.6 |
| NB-88 | 50% Spruce<br>50% Balsam Fir | 0.97 | 13.4 | 620 | 18.7 | 7.7 | 2.0 |
| K-10S | 90% Western Red Cedar<br>10% Hemlock | 1.16 | 14.6 | | 21.7 | 5.9 | 2.8 |
| Marathon | 60% Jack Pine<br>40% Spruce | 0.97 | 15.6 | 580 | 19.5 | 6.6 | 1.7 |

It has been discovered that pulps of the type like NB-88, MARATHON® and K-10S show substantially increased strength, when used in conjunction with cationic wet strength resins and anionic processing aids. With no strength additives the dry sheet tensile strength is proportional to the relative bonded area (RBA). The bonds that bond the tissue together are van der Waals bonds and hydrogen bonds. When the sheet is wetted these bonds are disrupted and therefore the sheet has a resulting low tensile strength value. Looking at the graph of 100% softwood (FIG. 3) it would be predicted that K-10S would have the highest RBA, followed by MARATHON®, NB-88, and finally LL-19. The 100% softwood data corresponds to the above fiber morphology data. RBA is determined by a method disclosed in Ingmanson and Thode, TAPPI Vol. 42, No. 1, January 1959, which disclosure is incorporated herein by reference.

When wet strength resins are present in a sheet, one of the primary mechanisms of failure is shearing the cell wall. The more covalent bonds that are present on the fiber wall will cause the tensile force to be distributed more along the fiber. The individual fiber can now see more tensile force before cell wall failure occurs since any given fiber section sees a lower tensile force. This is one of the reasons that KYMENE® 450 and KYMENE® 2064 usually outperform KYMENE® 557LX. They react with not only carboxyl groups, but also hydroxyl groups. Part of this strength development is the strength added to the wetted sheet by the crosslinking that occurs within the polymer. Therefore total wet tensile can be attributed to 1) the number of crosslinkings that the wet strength polymer undergoes, 2) the number of covalent bonds to the pulp fiber.

Pulp was analyzed by titration to give the amount of carboxyl sites on the pulp (see Table 1). These values were determined by TAPPI standard method T237, om-88, the disclosure of which is incorporated herein by reference. There was a small difference between that of LL-19 and NB-88, in that LL-19 was 0.6 meq/100 g higher. K-10S proved to be the highest at 2.8 meq/100 g. The carboxyl content is important due to the creation of the ionic bonding between the pulp and the cationic wet strength polymer, which determines wet strength resin retention. The carboxyl group also covalently bonds with the azentadinium (KYMENE® 557LX) or the epoxide (KYMENE® 450 and KYMENE® 2064) group to give permanent wet strength. LL-19 and NB-88 pulp samples were analyzed by FTIR and Raman spectroscopy to look for differences in hydroxyl and carboxyl groups. It was found that no significant difference was present.

Table 2 gives some KYMENE® retention data. KYMENE® retention is measured by using fluorescence spectroscopy.

TABLE 2

| Furnish | Chemistry | Amount Added (Kg/MT) | % Retained |
|---|---|---|---|
| 100% LL-19 | KYMENE ® 557LX/CMC | 12/3 | 64.5% |
| 100% NB-88 | KYMENE ® 557LX/CMC | 12/3 | 55.5% |
| 100% K-10S | KYMENE ® 557LX/CMC | 12/3 | 63.0% |
| 62.5% LL-19/ 37.5% BCTMP | KYMENE ® 450/CMC | 12/3 | 64.0% |
| 62.5% NB-88/ 37.5% BCTMP | KYMENE ® 450/CMC | 12/3 | 59.4% |

Upon looking at the carboxyl content, LL-19 should have a higher retention of wet strength resin than that of NB-88. This is verified by looking at the retention data for 100% LL-19 vs. 100% NB-88 and 62.5% LL-19/37.5% Bleached Chemi-Thermal Mechanical Pulp (BCTMP) vs. 62% NB-88/37.5% BCTMP. K-10S would be predicted to have the highest retention value as seen in the retention data with a high value of 63%.

One possible explanation of the mechanism behind the wet strength development with Northern Softwood Kraft (NSWK) fibers can be explained by looking at the morphology data (all morphology data was collected using the Kajaani FS-200 Fiber Analyzer supplied by Valmet Automation, Inc. Kajaani Division, Norcross, Ga. The experimental procedure to determine morphology using this apparatus is published in the FS-200 operating manual, which is available from Valmet, the disclosure of which is incorporated herein by reference.) LL-19 has the highest number of individual fibers per unit mass, next is NB-88, K-10S, and Marathon. Looking at the carboxyl content, K-10S has the highest carboxyl content, next is LL-19, NB-88, and finally Marathon. The fewer the fibers per given unit of mass or basis weight, the more covalent bonds per fiber can form which will result in a stronger sheet. The greater the carboxyl content of the fiber determines the available sites for covalent bonding with the wet strength resin. Thus, it is theorized that those two mechanisms combine to give the expected and synergistic effects of the present invention. Although this is the present theory, this theory in no way limits the scope of this invention. It is merely provided as an explanation for this synergistic and unexpected results obtained by the present invention in an effort to further the knowledge of this art.

Trials were conducted using a continuous handsheet former that was configured to operate in an uncreped through-air-dried mode to evaluate the following process parameters:

1. Effects of 100% NSWK fiber furnish
   A. 100% single NSWK fiber furnish
   B. Mixture of LL-19 with NB-88 and Marathon
2. Effects of 62.5% NSWK/37.5% (BCTMP) mixture

EXAMPLE 1

100% NSWK Pulps

Furnishes consisting of 100% NSWK (see Table 3) were dispersed separately in a hydrapulper for 20 minutes at 4% consistency. Each furnish was transferred to a dump chest and ultimately to a machine chest. Once in the machine chest, each furnish was diluted to 1% consistency. Kymene® 450 was added to the 1% stock at an add-on rate of 12 Kg/Tonne and allowed to agitate for 10 minutes. Subsequently, 3 Kg/Tonne of carboxymethyl cellulose (CMC) was added to the same stock. The entire mixture of pulp and resin was allowed to mix for another 10 minutes prior to tissuemaking.

Each aqueous mixture of pulp and resin was made into tissue in a similar fashion. The thick stock was further diluted to 0.1% at the fan pump and deposited onto an Albany 94M forming fabric via the headbox. After vacuum dewatering, the web was rush transferred at −20% to a Lindsay 965 fabric using a vacuum pick-up shoe. The web was then transferred to a Lindsay T-119-3 fabric, which was wound through an electrical through-air-dryer and dried to a consistency of 95%. The dried web was wound into a softroll at the reel.

All softroll samples were conditioned for a minimum of four hours as 23 C and 50% relative humidity prior to testing. MD and CD dry tensile was measured using the following procedure. A one-ply, three-inch wide sample was cut in the specified direction using a standard cutting board. The three inch wide strip was inserted into the jaws of an Instron, Model No. 1122 (Instron Inc., Canton, Mass.), with a four-inch span. The specimen was extended until failure using a crosshead speed of ten inches per minute. The tensile and stretch values are recorded. A total of ten specimens were tested. The MD and CD modulus of the tissue were measured by calculating the slope of the stress/strain curve between 70 g and 157 g.

Wet tensile testing was performed in a similar manner. Prior to testing, each specimen was cut to a three-inch wide strip and artificially aged for five minutes at 105 C. Once aged, each specimen was formed into a loop by holding both ends of the test specimen and dipping it into distilled water such that the water completely wet the specimen. Excess water was removed by touching the wetted lower most curve of the loop with blotter paper. The specimen was then inserted into the Instron and measured according to the above procedure. Care was taken not to allow water to wick too far up the specimen; otherwise failure will occur at the jaws producing erroneous results.

As used herein, the term "GMT" is equal to the square root of the product of the dry MD tensile multiplied by the dry CD tensile. The GMMod (GM Modulus) is equal to the square root of the product of the dry MD modulus multiplied by the dry CD modulus.

From this data in Table 3, there is evidence of synergism between pulps with superior RBA and KYMENE® 450 and CMC. 100% MARATHON®, NB-88 and K-10S are all significantly higher in CD wet tensile and lower in stiffness in the presence of Kymene 450 and CMC than LL-19.

Some additional results and observations made regarding these furnishes are set forth below.

A. 100% single NSWK fiber furnish

Using KYMENE® 450/CMC, K-10S gave the highest GMT, followed by MARATHON®, NB-88, and finally LL-19 in descending order.

Using KYMENE® 450/CMC, K-10S gave the highest CD Wet, followed by NB-88, MARATHON®, and finally LL-19 in descending order.

With no chemicals added and making no statistical claims, LL-19 produced the lowest tensile values, both CD Wet and GMT.

With no chemicals added, K-10S and MARATHON® GMT tensile values were greater than LL-19 and NB-88.

With wet strength chemicals, 100% NSWK had higher GMT and CD Wet than the 62.5% NSWK/37.5% BCTMP furnishes.

With wet strength chemicals, 100% NSWK had higher GMT and CD Wet than the 62.5% NSWK/37.5% BCTMP furnishes.

KYMENE® 557LX/CMC produced slightly higher GMT than Kymene® 450/CMC in NB-88 and K-10S. However, due to the CHF trails being on separate time periods, there is too much variability involved with making any accurate conclusions.

KYMENE® 2064®/CMC gave a 34% higher GMT and a 29% higher CD Wet tensile, with essentially equal Wet/Dry ratio of 40% in NB-88 vs. LL-19.

B. Mixture of LL-19 with NB-88 and Marathon

At the 25% super softwood (SSW) substitution, both NB-88 and K-10S produced a 8.5% and 11.9% significant increase in CD Dry tensile from 15% SSW substitution.

At the 100% NB-88 and K-10S, a 3.7% and a 12.3% significant increase in CD Dry tensile was observed from the 50% SSW substitution.

At the 15% SSW substitution, both NB-88 and K-10S produced an 18.8% and an 11.1% significant increase was observed in CD Wet from the 100% LL-19 composition.

The 40% NB-88 substitution produced a 14% significant increase was observed in CD Wet from the 25% NB-88 substitution.

The 50% K-10S substitution produced a 12.8% significant increase in CD Wet tensile over that of 40% K-10S substitution.

The 100% level of SSW, both NB-88 and K-10S, produced a 13.6% and a 19.3% significant increase in CD Wet tensile over the 50% SSW substitution.

EXAMPLE 2

62.5% NSWK/37.5% BCTMP mixture

Using similar conditions to those used in Example 1, with a blended sheet having 62.5% NSWK and 37.5% BCTMP, the following was observed.

At the 95% confidence level with KYMENE® 450/CMC, 62.5% NB-88/37.5% BCTMP was significantly higher in CD Wet and GMT than 62.5% MARATHON®/37.5% BCTMP and 62.5% LL-19/37.5% BCTMP.

At the 95% confidence level with KYMENE® 450/CMC, 62.5% MARATHON® 37.5% BCTMP was higher in CD Wet tensile and GMT than 62.5% LL-19/37.5% BCTMP.

With no chemicals, the fiber furnishes offered no significant differences for GMT, CD Wet tensile, and Wet/Dry.

The chemistry of KYMENE® 2064/CMC offered no significant difference in CD Wet tensile and GMT in the 62.5% MARATHON®/37.5% BCTMP and 62.5% NB-88/37.5% BCTMP furnishes.

There is evidence of synergism between specific pulp types, cationic wet strength resins and anionic processing aids. For example, a synergism between NB-88 and KYMENE® 450 and CMC was shown in the examples. 100% NB-88 is significantly higher in CD Wet tensile and GMT with KYMENE® 450/CMC than 100% LL-19. 62.5% NB-88/37.5% BCTMP is significantly higher in CD Wet tensile and GMT with KYMENE® 450/CMC than with 62.5% LL-19/37.5% BCTMP. NB-88 and LL-19, both as single pulp furnishes and combined with BCTMP, have essentially the same strengths when no chemistry is present. Similarly, K-10S and MARATHON® in the presence of KYMENE® 450/CMC have the same synergistic effect, as does NB-88, in the presence of KYMENE® and CMC. K-10S proved to be the most superior NSWK pulp of the material in the examples. A substitution of NB-88 or K-10S with LL-19 at the 25–35% range provided a significant synergistic improvement in CD Wet tensile and GMT at the 95% confidence level. These conclusions and data are graphically depicted in FIGS. 3A, 3B and 3C.

Data comparing sheets that utilize the present invention with sheets that do not are set forth in Table 3.

TABLE 3

| | Chemical Addition (Kg/Tonne) | | Rush | Softroll BW | Dry Tensile (g) | | | CD Wet Tensile (g) | CD Wet/ | Specific | |
|---|---|---|---|---|---|---|---|---|---|---|---|
| Furnish | Kymene 450 | CMC-7MT | Transfer (%) | (lbs/ 2880 sq ft) | MD | CD | GMT | (aged) | Dry Tensile (%) | GM Modulus (g) | GM Mod/ GMT |
| 62.5% LL-19/37.5% BCTMP | 12 | 3 | 20 | 25.4 | 2273 | 1721 | 1978 | 665 | 38.6 | 11808 | 5.97 |
| 62.5% LL-19/37.5% BCTMP | 18 | 7.5 | 20 | 25.9 | 2591 | 1854 | 2162 | 727 | 39.2 | 12742 | 5.89 |
| 62.5% NB-88/37.5% BCTMP | 12 | 3 | 20 | 25.7 | 2668 | 1836 | 2213 | 724 | 39.4 | 9823 | 4.44 |
| 62.5% NB-88/37.5% BCTMP | 18 | 7.5 | 20 | 26 | 2893 | 2105 | 2468 | 852 | 40.5 | 9274 | 3.76 |
| 100% LL-19 | 12 | 3 | 20 | 23.47 | 2424 | 1593 | 1965 | 593 | 37.2 | 26181 | 13.3 |
| 100% Marathon | 12 | 3 | 20 | 24.09 | 3287 | 2043 | 2592 | 686 | 33.6 | 28189 | 10.9 |
| 100% NB-88 | 12 | 3 | 20 | 23.51 | 3019 | 1840 | 2357 | 775 | 42.1 | 16762 | 7.11 |
| 100% K-10S | 12 | 3 | 20 | 23.32 | 4746 | 2069 | 3134 | 855 | 41.3 | 18629 | 5.94 |

What is claimed is:

1. A strong soft absorbent paper product comprising:

paper making fibers, an anionic processing aid, and a cationic wet strength resin; the product having a basis weight of from about 15 to about 80 grams/square meter; a geometric mean tensile (GMT) of at least about 2200 g.; and a geometric mean modulus (GMM) of less than about 11,000 g;

wherein the paper making fibers comprise paper making fibers having a % relative bonded area (RBA) of from about 17 to about 22.

2. The paper product of claim 1 wherein the paper making fibers comprise paper making fibers having a number of fibers per gram of from about 5 million to about 9 million, and a carboxyl content in meq/100 g of from about 1.5 to about 3.0.

3. The paper product of claim 1 wherein the product is a paper towel and the paper making fibers further comprise paper making fibers having a % relative bonded area (RBA) of at least about 17 and the anionic processing aid is a carboxymethylcellulose.

4. The paper product of claim 1, 2 or 3, wherein the product is multilayered.

5. The paper product of claim 1 wherein the ratio of GM Modulus over GM Tensile is less than about 12.

6. A strong soft absorbent paper product comprising:

paper making fibers having less than 9 million fibers per gram; an anionic processing aid; and less than about 18 Kg./metric ton of a cationic wet strength resin; the paper product having a basis weight of from about 30 to about 50 grams/square meter; and a wet CD tensile of at least about 730 g;

wherein the paper making fibers comprise paper making fibers having a carboxyl content in meg/100 g of from about 1.5 to about 3.0.

7. The paper product of claim 6 wherein the paper making fibers comprise paper making fibers having a % relative bonded area (RBA) of from about 17 to about 22, and a number of fibers per gram of from about 5 million to about 9 million.

8. The paper product of claim 6 wherein the product is a paper towel and the paper making fibers further comprise paper making fibers having a % relative bonded area (RBAI of from at least about 17; and the anionic processing aid is a carboxymethylcellulose.

9. The paper product of claim 6, 7 or 8, wherein the product is multilayer.

10. A strong soft absorbent paper product comprising:

paper making fibers, an anionic processing aid, and a cationic wet strength resin; the product having a basis weight of from about 15 to about 80 grams/square meter; a GMT of at least about 2200 g.; and a geometric mean modulus (GMM) of less than about 10,000 g;

wherein the paper making fibers comprise paper making fibers having a % relative bonded area (RBA) of from about 17 to about 22, and a carboxyl content in meg/100 g of from about 1.5 to about 3.0.

11. The paper product of claim 10 wherein the ratio of GM Modulus over GM Tensile is less than about 12.

12. A strong soft absorbent paper product comprising: paper making fibers selected from the group consisting of (a) 50% spruce and 50% balsam fir pulp, (b) 60% jack pine and 40% spruce pulp, and (c) 90% western red cedar and 10% hemlock pulp; an anionic processing aid, and a cationic wet strength resin; the paper product having a geometric mean tensile (GMT) of at least about 2,200 g; and a basis weight of from about 25 to about 50 grams/square meter.

* * * * *